US011833643B2

(12) United States Patent
Mok

(10) Patent No.: US 11,833,643 B2
(45) **Date of Patent: *Dec. 5, 2023**

(54) PRESSING AND DRIVING MECHANISM AND ELECTRIC SCREWDRIVER CONTAINING THE SAME

(71) Applicant: TECHTRONIC CORDLESS GP, Anderson, SC (US)

(72) Inventor: Kwok Ting Mok, Hong Kong (CN)

(73) Assignee: TECHTRONIC POWER TOOLS TECHNOLOGY LIMITED, Tortola (VG)

( * ) Notice: Subject to any disclaimer, the term of this patent is extended or adjusted under 35 U.S.C. 154(b) by 0 days.

This patent is subject to a terminal disclaimer.

(21) Appl. No.: 17/732,704

(22) Filed: Apr. 29, 2022

(65) Prior Publication Data

US 2022/0250215 A1 Aug. 11, 2022

Related U.S. Application Data

(63) Continuation of application No. 16/601,197, filed on Oct. 14, 2019, now Pat. No. 11,345,002.

(30) Foreign Application Priority Data

Nov. 5, 2018 (CN) ..... 201821816783.0

(51) Int. Cl.
*B25B 21/02* (2006.01)
*B25B 21/00* (2006.01)

(52) U.S. Cl.
CPC ..... *B25B 21/008* (2013.01); *B25B 21/02* (2013.01)

(58) Field of Classification Search
CPC ..... B25F 5/00; B25B 21/02; B25B 21/002; B25B 21/008; B25B 21/00; B25B 21/023; B25B 21/004; B25B 21/005; B25B 21/007; B25B 17/00; B25B 23/00
See application file for complete search history.

(56) References Cited

U.S. PATENT DOCUMENTS 3,683,308 A * 8/1972 Hamill ..... H01C 1/12 338/162
5,255,891 A * 10/1993 Pearson ..... F16K 31/043 251/308
6,359,545 B1 * 3/2002 Bressers ..... H01C 10/30 338/160

(Continued)

*Primary Examiner* — Robert J Scruggs
(74) *Attorney, Agent, or Firm* — Michael Best & Friedrich LLP

(57) ABSTRACT

A pressing and driving mechanism adapted for use with an electric screwdriver, the pressing and driving mechanism including a housing, an output assembly connected to the housing for sliding movement relative to the housing, an anvil coupled to the output assembly for sliding movement therewith relative to the housing and configured to receive rotational impacts, a shuttle coupled to the output assembly for movement therewith relative to the housing, a terminal assembly connected to the shuttle and movable with the same, and a printed circuit board fixed relative to the housing and adapted to be in mechanical contact with the terminal assembly. The terminal assembly and the printed circuit board form a potentiometer with a resistance value that is variable in dependence upon a position of the terminal assembly relative to the printed circuit board.

20 Claims, 11 Drawing Sheets

(56) References Cited

U.S. PATENT DOCUMENTS

| | | | | |
|---|---|---|---|---|
| 11,345,002 | B2 * | 5/2022 | Mok | B25F 5/00 |
| 2012/0292063 | A1 | 11/2012 | Forster et al. | |
| 2015/0174744 | A1 * | 6/2015 | Scott | B25B 21/02 173/15 |
| 2017/0288583 | A1 | 10/2017 | Ma et al. | |
| 2018/0323735 | A1 * | 11/2018 | Kong | H01C 10/30 |

* cited by examiner

PRESSING AND DRIVING MECHANISM AND ELECTRIC SCREWDRIVER CONTAINING THE SAME

CROSS-REFERENCE TO RELATED APPLICATIONS

This application is a continuation of co-pending U.S. patent application Ser. No. 16/601,197 filed on Oct. 14, 2019, the entire content is incorporated herein by reference.

FIELD OF THE DISCLOSURE

The invention relates to an electric screwdriver, in particular to a mechanism and a method capable of controlling an operational speed of the electric screwdriver by pressing the electric screwdriver onto a surface of an object.

BACKGROUND

An electric screwdriver is a power tool commonly used in interior decoration and furniture installation. Just like tightening a screw by a human hand, an electric screwdriver also requires variation in its output torque and speed during the tightening of the screw. When the screw just enters the workpiece to be drilled (for example, a wooden board), it is able to rotate at a relatively high speed due to a small resistance encountered, and the torque required at this time is not large. However, as the screw gradually penetrates into the workpiece, the resistance encountered is increasing, and in particular it increases to the maximum when the screw is almost completely entering the workpiece. At this time, the screw does not need to rotate at a high speed, but the torque required by the screw is very large. Conventional electric screwdrivers generally control the speed/torque by the user directly controlling the amount of pulling of a trigger, but such a method requires the user to be more experienced and also to exert more intervention, thus making the screwdriver inconvenient during use. Moreover, only using the trigger to control the output of the electric screwdriver is not flexible enough to meet the needs of users on electric screwdrivers in various applications.

On the other hand, there are more and more power tools with a push-to-drive function. For example, in the field of nail guns, a nail gun equipped with the push-to-drive function is fired only when a head of the nail gun is pressed by the user onto the surface of the workpiece (such as a wall), thereby ensuring that no accident such as accidently firing would damage the user.

SUMMARY

The embodiments of the invention provide a pressing and driving mechanism adapted for an electric screwdriver. The pressing and driving mechanism including a housing, an output assembly connected to the housing for sliding movement relative to the housing, and an anvil coupled to the output assembly for sliding movement therewith relative to the housing, the anvil configured to receive rotational impacts. The pressing and driving mechanism further includes a shuttle coupled to the output assembly for movement therewith relative to the housing, a terminal assembly connected to the shuttle and movable with the same, and a printed circuit board fixed relative to the housing and adapted to be in mechanical contact with the terminal assembly. The terminal assembly and the printed circuit board form a potentiometer with a resistance value that is variable in dependence upon a position of the terminal assembly relative to the second printed circuit board.

In another aspect of the invention, the embodiments of the invention provide a pressing and driving mechanism adapted for an electric screwdriver. The pressing and driving mechanism including a housing, an output assembly connected to the housing for sliding movement relative to the housing in response to user intervention from a first position to a second position, and an impact mechanism including an anvil coupled to the output assembly, a camshaft configured to be driven by the motor to rotate, and a hammer coupled to and driven by the camshaft to impart rotational impacts to the anvil. The pressing and driving mechanism further includes a shuttle operatively coupled to the output assembly for movement therewith relative to the housing, and a first metal contact configured to be received by the shuttle. The first metal contact is movable with the output assembly between the first position and the second position.

In another aspect of the invention, the embodiments of the invention provide an electric screwdriver. The electric screwdriver including a housing, a motor supported by the housing, an output assembly connected to the housing for sliding movement relative to the housing between a forwardmost position and a rearmost position, and an anvil coupled to the output assembly for sliding movement therewith relative to the housing, the anvil configured to receive rotational impacts. The electric screwdriver further includes a shuttle coupled to the output assembly for movement therewith relative to the housing, a terminal assembly connected to the shuttle and movable with the same, and a printed circuit board fixed relative to the housing and adapted to be in mechanical contact with the terminal assembly. The terminal assembly and the printed circuit board form a potentiometer configured to prevent the motor from operating when the output assembly is in the forwardmost position. The potentiometer is configured to permit the motor to operate when the output assembly is in the rearmost position.

BRIEF DESCRIPTION OF THE DRAWINGS

The performance and advantages of the invention will be further understood by reference to the remainder of the specification and the accompanying drawings. A same component in these drawings has the same label. In some cases, a subtag is placed after a label and a hyphen to represent one of many similar components. When tag is referred to but no particular subtag is mentioned, then it refers to all of similar components.

DETAILED DESCRIPTION OF PREFERRED EMBODIMENTS

Embodiments of the invention use a pressing and driving mechanism that constitutes a potentiometer to automatically adjust the output speed/torque when the head is pressed onto the surface of the workpiece. Other different benefits and advantages provided by the various embodiments of the invention are readily apparent from the following description.

Figure 1:
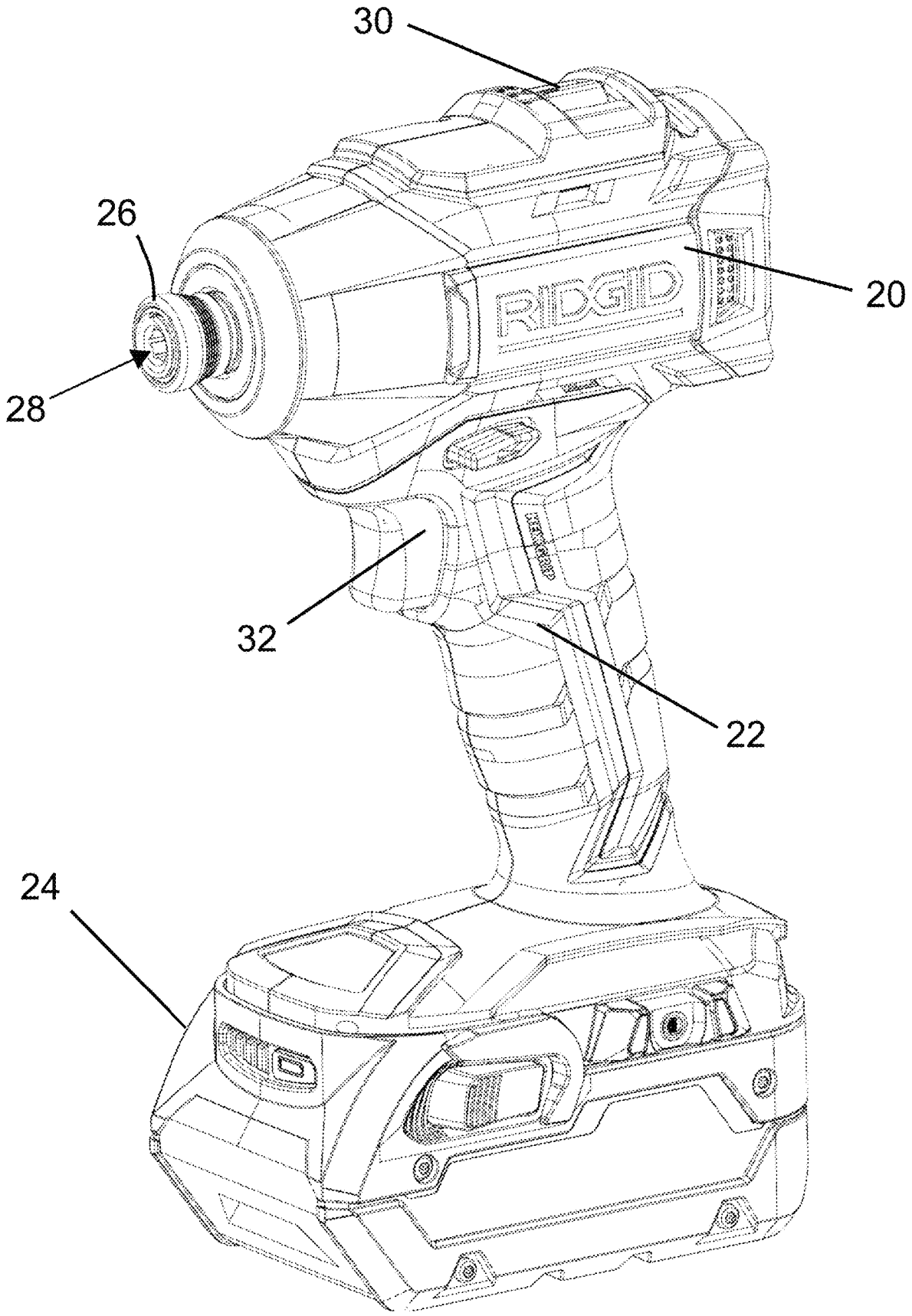
FIG. 1 is an external view of an electric screwdriver according to an embodiment of the invention.
Figure 2:
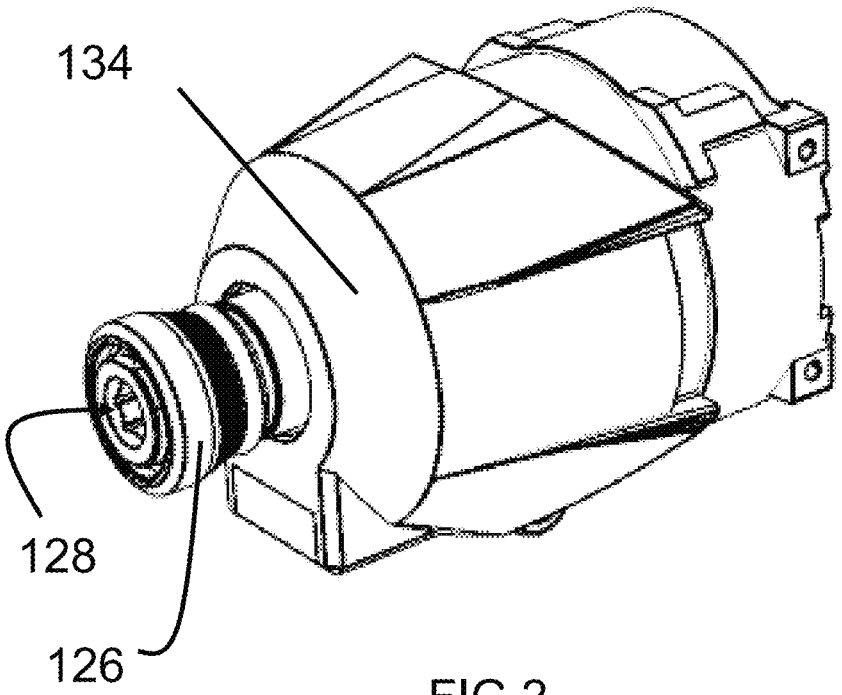
FIG. 2 is an external view of a pressing and driving mechanism which can be used in a power tool such as an electric screwdriver, according to an embodiment of the invention.

Turning first to FIG. 1, a portable electric screwdriver is illustrated according to one embodiment of the invention. The electric screwdriver includes a main body 20, a handle portion 22 connected to the main body 20 at one end of the handle portion 22, and a detachable battery pack 24 connected to the handle portion 22 at the other end thereof. A front end of the main body 20 is connected to a head 26 that is movable relative to the main body 20, particularly when the user presses the head 26 of the electric screwdriver onto a workpiece (not shown). Accordingly, the main body 20 has a pressing and driving mechanism (not shown) therein to output a signal according to the movement of the head 26 relative to the main body 20, thereby controlling the operation of the electric screwdriver. The head 26 has a bayonet 28 at the center for connecting to a working component (not shown) or a tool, such as a screwdriver blade. A mode changeover switch 30 is disposed on the upper portion of the main body 20, and a trigger 32 is disposed on the handle portion 22. The mode changeover switch 30 is connected to a control unit (not shown) inside the electric screwdriver, and for example, it is adapted to control the operation mode of the electric screwdriver. The trigger 32 is operated by the user and controls the starting and stopping of the electric screwdriver, as well as its output speed. These components and general functions of the above-described electric screwdriver are well known to those skilled in the art and will not be described in details.

Turning to FIGS. 2-4, 5*a* and 5*b*, there shows a pressing and driving mechanism suitable for use with a power tool, such as the electric screwdriver shown in FIG. 1. The pressing and driving mechanism has a housing 134 and a head 126 at the front end of the housing 134. It is to be noted that the housing 134 may be part of the overall housing of the power tool or may be housed inside the housing of the power tool. The head 126 has a bayonet 128 at the center for connecting to a working component (not shown) or a tool, such as a screwdriver blade. The pressing and driving mechanism shown in FIG. 3 includes a camshaft 138 adapted to be connected to a power source (e.g., a motor and/or a gear shift mechanism associated therewith, not shown). The camshaft 138 is rotatable such that a hammer is driven by the camshaft 138 to produce rotational and impact motions due to complementary cam features with the camshaft 138. Such rotational and impact motions are transmitted to the anvil 140 through the hammer. The above driving principle is also well known to those skilled in the art and will not be described herein.

Figure 3:
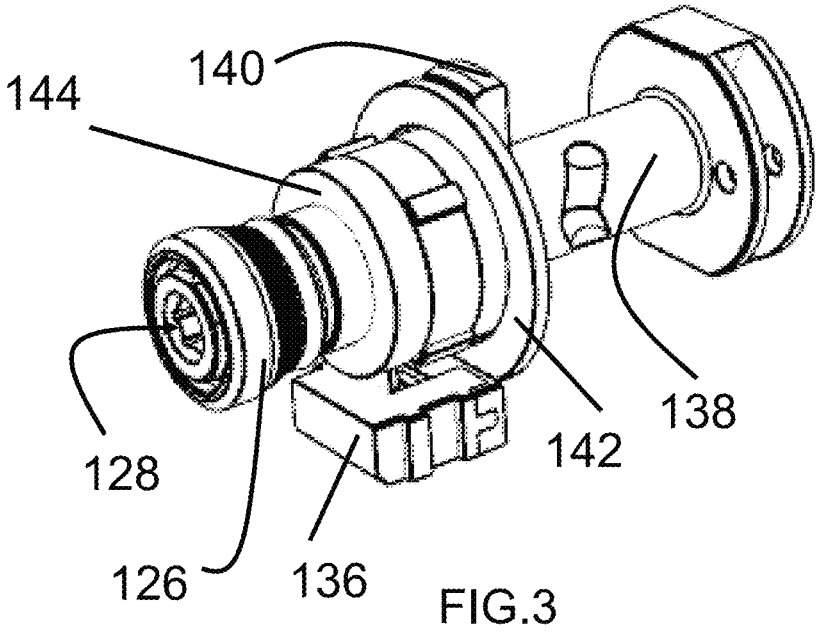
FIG. 3 is a schematic view of internal components of the pressing and driving mechanism of FIG. 2 after removal of a housing.

FIG. 3 also shows a washer 142, so that the anvil mentioned above is attached to the inside wall of the housing 134 by the washer 142. Additionally, the pressing and driving mechanism also includes a generally cylindrical torque transmitting member 144 or torque transmitting shaft 144. The torque transmitting member 144 is connected at one end to the head 126, such that the torque transmitting member 144 and the head 126 are axially movable relative to the housing 134 and they constitute the output member or output assembly, of the electric screwdriver. At the same time, the torque transmitting member 144 is sleeved by its non-circular joint portion 144*a* with the corresponding non-circular ring portion 140*a* of the anvil 140, so that when the anvil 140 has rotational and impact motions (i.e., linear motion), the torque transmitting member 144 also produces rotational and impact motions together. Specifically, the above-described joint portion 144*a* and ring portion 140*a* each include two straight linear gears in the circumferential direction (for example, a straight linear contour 144*b* on the joint portion 144*a* shown in FIG. 4*a*), and other portions in the circumferential direction are still circular arc shaped. This makes the transfer of the rotational motion possible. The pressing and driving mechanism also includes a driving portion 136 which is generally located below the torque transmitting member 144. The driving portion 136 can generate a change in circuit characteristics due to the axial movement of the torque transmitting member 144, thereby outputting signals directly or indirectly.

Figure 4A:
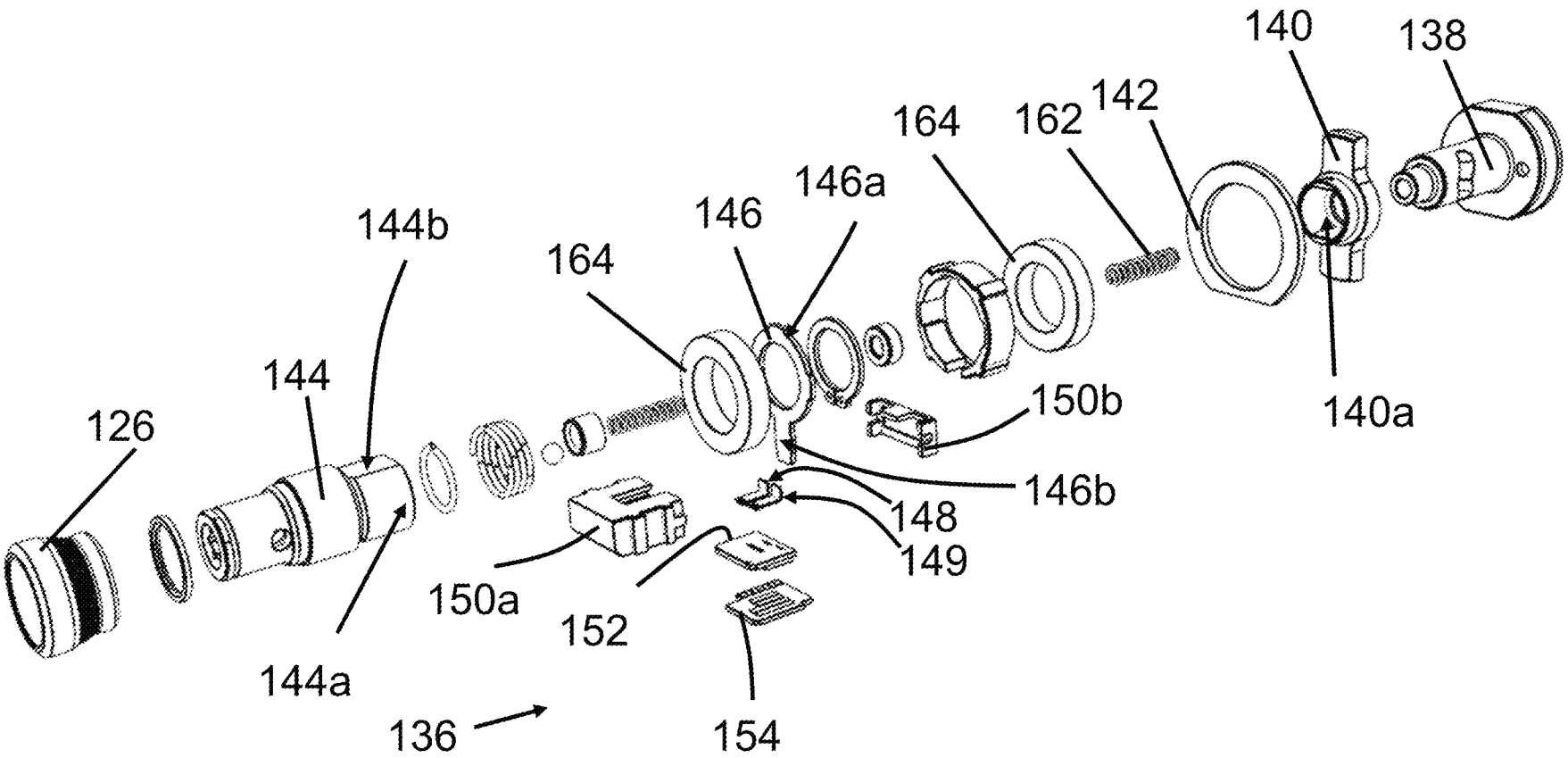
FIG. 4*a* is an exploded view of all components of the pressing and driving mechanism of FIG. 2, but without containing the housing.
Figure 4B:
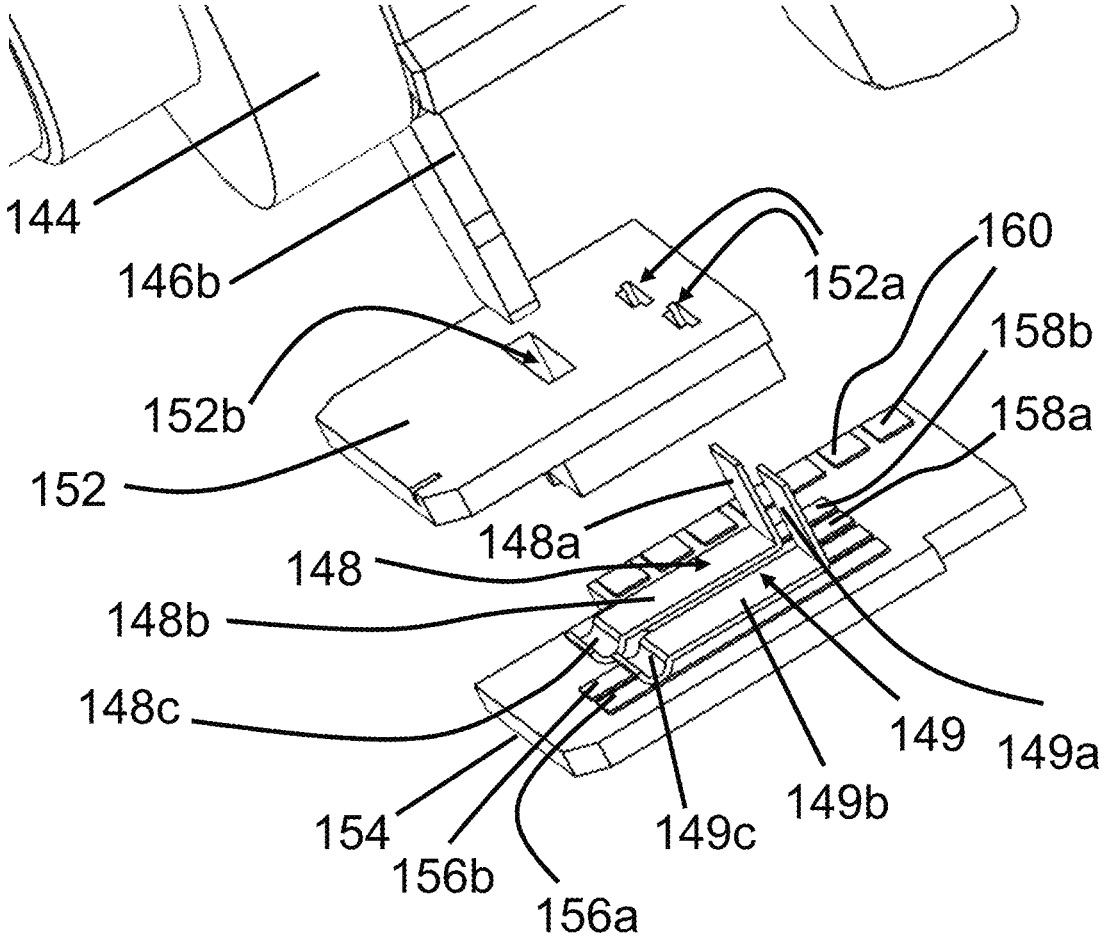
FIG. 4*b* is an exploded view of a driving unit of the pressing and driving mechanism of FIG. 2.

Specifically, as shown in FIG. 4*a*, the torque transmitting member 144 is slidably secured to the housing 134 by two bearing members 164. Further, the other end of the torque transmitting member 144 opposite to the end where the head 126 is located is connected to a spring 162 which is simultaneously connected to the cam shaft 140. On the torque transmitting member 144, a dial piece 146 is sleeved. As shown in FIGS. 4*a*-4*b*, the dial piece 146 has a circumferential portion 146*a* and a dialing portion 146*b* that projects from the circumferential portion 146*a* and extends downwardly. The dial piece 146 is rotatable relative to the torque transmitting member 144, for example, the dial piece 146 may not rotate when the torque transmitting member 144 rotates. However, since the circumferential portion 146*a* of the dial piece 146 abuts against a portion 144*c* with larger diameter of the torque transmitting member 144, the axial movement of the torque transmitting member 144 causes the dial piece 146 to move axially together.

The dialing portion 146*b* of the dial piece 146 is connected to the driving portion 136, and in particular to an intermediate member 152 or shuttle 152. The driving portion 136 includes two half-shells 150*a* and 150*b* which can be joined to each other to constitute an internal space. The intermediate member 152 has three openings therein, one of the openings 152*b* receiving the dialing portion 146*b* of the dial piece 146 for insertion, and the other two through-holes 152*a* for receiving one end of the metal contacts 148 and 149, respectively. As shown in FIG. 4*b* in detail, the metal contacts 148 and 149 each have an L-shaped shape and are in the form of a thin sheet. The respective upper ends 148*a* and 149*a* of the metal contacts 148 and 149 are inserted into the two openings 152*a* of the intermediate member 152 described above. The respective lower ends 148*b* and 149*b* of the metal contacts 148 and 149 are generally at right angles to the upper ends 148*a* and 149*a*, respectively, and the lower ends 148*b* and 149*b* are substantially parallel to a PCB board 154. At the trailing end of the lower ends 148*b* and 149*b*, two hook portions 148*c* and 149*c* are formed, respectively. Among them, the hook portion 148*c* is selectively intended for mechanical contact with the two parallel printed metal wires 158*a*, 158*b* on the PCB board 154. Mechanical contact here means that the two components are in direct, physical contact. The hook portion 149*c* is for mechanical contact with the other two parallel strips on the PCB board 154, such as carbon films 205*a* and the printed metal wires 156*b*. The above printed metal wires 158*a*, 158*b*, 156*b* and the carbon film 156*a* each have a predetermined length.

Therefore, the metal contacts 148 and 149 thus serve as two adjustment members or a terminal assembly, respectively, the two parallel printed metal wires 158*a*, 158*b* are defined on a printed circuit board, and the carbon film 156*a* and the printed metal wires 156*b* are also defined on the printed circuit board. The movement of these adjustment members, relative to each other, enables generation of different signals, as will be described in detail below.

The metal contact 149 and the printed metal wire 156*b* together with the carbon film 156*a* described above constitute a potentiometer. This is because the carbon film 156*a* has a large resistance, as will be understood by those skilled in the art. On the other hand, the printed metal wire 156*b* is a good conductor and thus has resistance values that are negligible. The metal contact 149 (specifically, the hook portion 149*c*) serves as a bridge between the electrically conductive carbon film 156*a* and the printed metal wire 156*b*. Therefore, the entire printed metal wire 156*b* and any one end of the carbon film 156*a* with the length together constitute two terminals of the potentiometer. By adjusting the position of the metal contact 149 relative to the carbon film 156*a*, the resistance presented by the potentiometer can be adjusted. The two terminals of the potentiometer are connected to two of the plurality of pins 160 on the PCB board 154 by a printed circuit on the back side of the PCB board 154 (not shown), so as to be connected to a controlling portion of the electric screwdriver (not shown).

On the other hand, the metal contact 148 together with the two printed metal wires 158*a*, 158*b* constitute a single-pole single-throw switch. At this time, the two printed metal wires 158*a*, 158*b* respectively constitute the two terminals of the switch. The printed metal wires 158*a*, 158*b* are excellent conductors and thus have inherent resistance values that are negligible. The metal contact 148 (and in particular the hook portion 148*c*) serves as a bridge between the two printed metal wires 158*a*, 158*b*. The hook portion 148*c* is movable between an open position that is out of contact with the two printed metal wires 158*a*, 158*b*, and a closed position that is simultaneously contact with the two printed metal wires 158*a*, 158*b*, which causes the above-described single-pole single-throw switch undergoes a change in state through linear movement of the metal contact 148. The two terminals of the switch are connected to two of the plurality of pins 160 on the PCB board 154 by printed circuit on the back side of the PCB board 154 (not shown) (but different from the two pins 160 of the corresponding potentiometer described above), so that it can be connected to the controlling portion of the electric screwdriver.

Figure 5A:
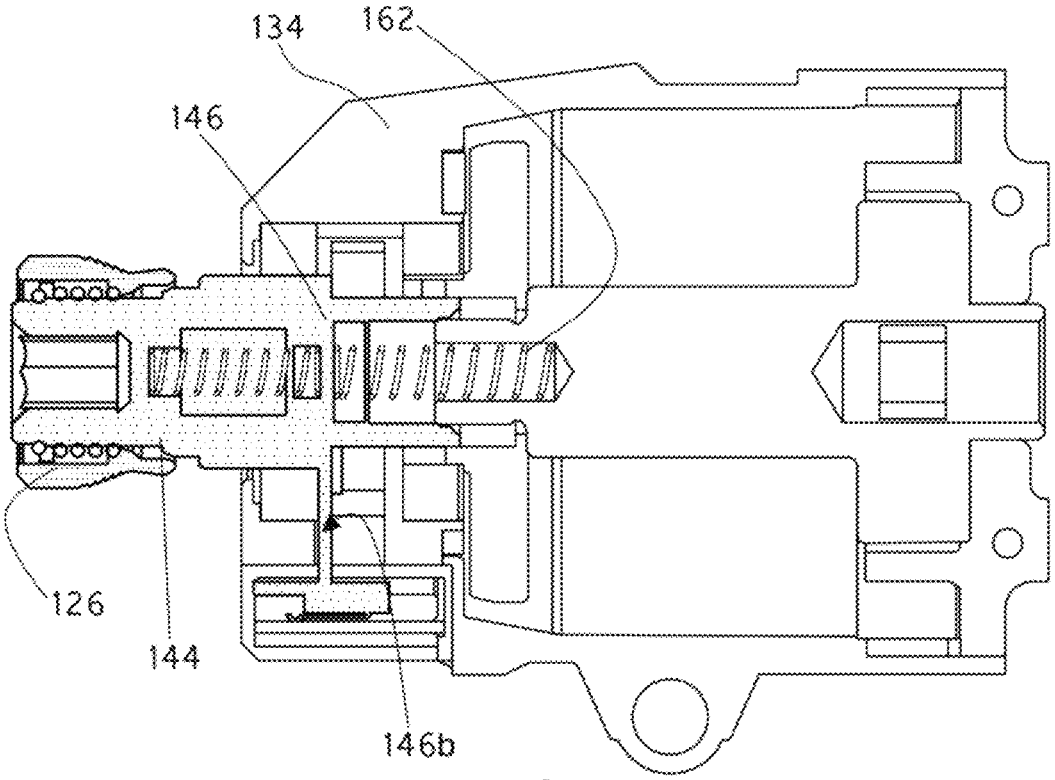
FIGS. 5*a* and 5*b* respectively show a cross-sectional state view of the pressing and driving mechanism of FIG. 2 when not pressed onto the surface of the workpiece, and a relative position between metal contacts and the printed metal wires and the carbon film on the PCB board at this moment.

After introducing the above-described structure of the electric screwdriver and its pressing and driving mechanism, the operation of the pressing and driving mechanism will now be described. FIGS. 5*a* and 5*c* respectively show schematic view of the internal states of the electric screwdriver when the electric screwdriver is not pressed onto the workpiece (e.g., walls, not shown) and the internal states of the pressing and driving mechanism when it is pressed onto the workpiece to the maximum extent. It is to be noted that the electric screwdriver cannot be pressed onto the workpiece until a working member or a tool (for example, a detachable screwdriver, not shown), is installed on the electric screwdriver and thereafter the working member is contact with the workpiece. In the state shown in FIG. 5*a*, the user does not apply a force on the electric screwdriver, so that the head 126 and the torque transmitting member 144 are in a most outwardly projecting position away from the housing 134 due to the restoring force exerted by the spring 162. At this time, the dial piece 146 and its dialing portion 146*b* are dialed so that the intermediate member 152 connected thereto is at the trailing end of one end of its effective stroke. This causes the metal contacts 148 and 149 connected to the intermediate member 152 to be in a first position shown in FIG. 5*b*. At this time, the hook portion 148*c* (shown as a line in FIGS. 5*b* and 5*d*) on the metal contact 148 is completely detached with the two printed metal wires 158*a*, 158*b* constituting the single-pole single-throw switch described above, and thus the switch is in the off state. The switch is connected to the controlling portion of the electric screwdriver as a signal input for activating the controlling portion (e.g., the main circuit), so that the main circuit is still in a sleep state while the switch is off. At this time, even if the user presses the trigger of the electric screwdriver, the motor will not operate. This design prevents the electric screwdriver from being accidentally activated when the user does not actually intend to work (e.g., when the workpiece is not touched and deliberately pressed), thus avoiding causing any possible injury. At the same time, the hook portion 149*c* (also shown as a line in FIGS. 5*b* and 5*d*) on the metal contact 149 is located at one end of its effective stroke relative to the carbon film 156*a*. At this time, the metal contact member 149, the printed metal wire 156*b* and the carbon film 156*a* constitute a potentiometer with the smallest resistance.

Starting from the state shown in FIG. 5*a*, if the user presses the electric screwdriver onto the surface of the workpiece at this time, the workpiece will cause the working member, the head 126, and the torque transmitting member 144 connected thereto to move linearly toward the housing 134. In other words, the output member of the electric screwdriver will move relative to the housing 134 only under user intervention. Due to the presence of the spring 162, the user needs to overcome the restoring force of the spring 162, and the pressing of the electric screwdriver by the user can cause the torque transmitting member 144 to displace. Since the dial piece 146 and its dialing portion 146*b* are adapted to move with the torque transmitting member 144 as described above, the linear displacement of the torque transmitting member 144 causes the dialing portion 146*b*, the intermediate member 152 and the metal contact member 148 and 149 to simultaneously produce a linear movement along the direction indicated by arrow 166 in FIG. 5*d*. During this movement, at a certain point, the hook portion 148*c* on the metal contact 148 will be disconnected from the two printed metal wires 158*a*, 158*b* constituting the single-pole single-throw switch described above, and become being in contact with the printed metal wires 158*a*, 158*b* at the same time, so as to electrically connect the printed metal wires 158*a*, 158*b*. In other words, the switch will now be in the closed state. As described above, the switch is connected to the controlling portion of the electric screwdriver as a signal input for activating the controlling portion (e.g., the main circuit), so that the main circuit is awakened when the switch is in the closed state. At this time, the motor can operate even if the user presses the trigger of the electric screwdriver. This design allows the electric screwdriver to activate only when the user actually works (such as when the workpiece is touched and deliberately pressed).

Figure 5B:
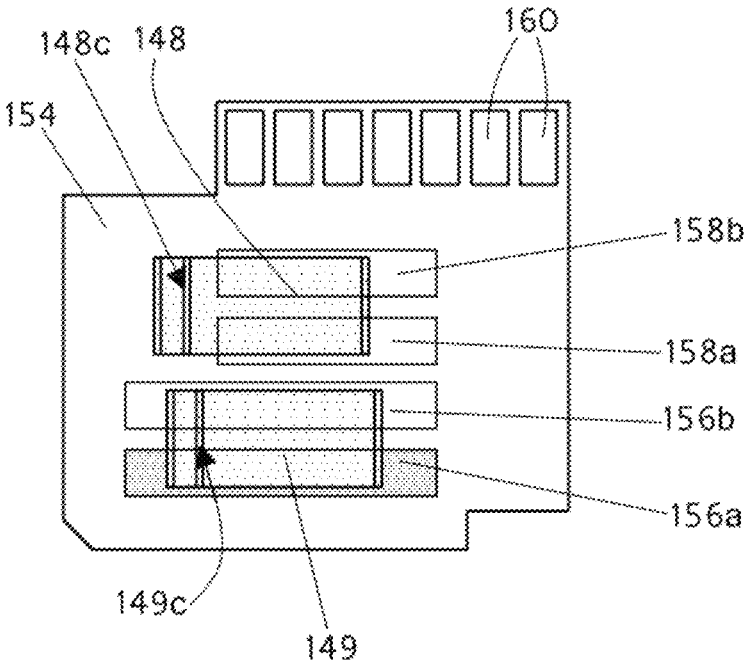
Figure 5C:
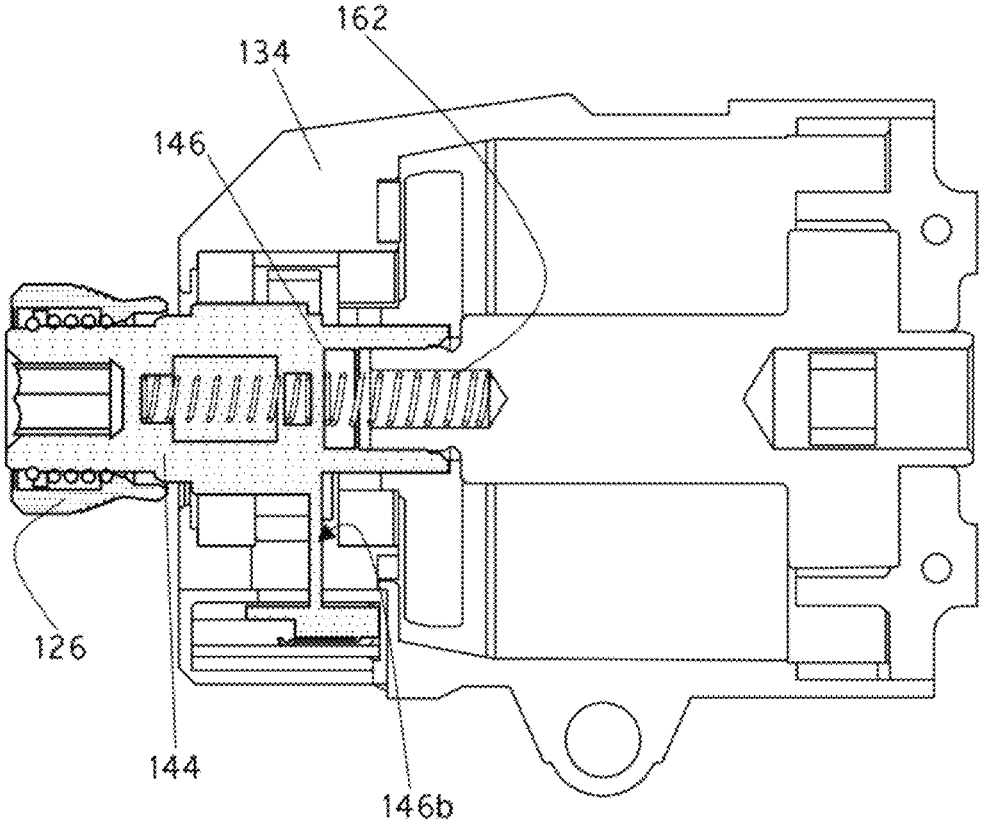
FIGS. 5*c* and 5*d* respectively show cross-sectional state views of the pressing and driving mechanism of FIG. 2 when fully pressed onto the surface of the workpiece, and a relative position between metal contacts and the printed metal wires and the carbon film on the PCB board at this moment.
Figure 5D:
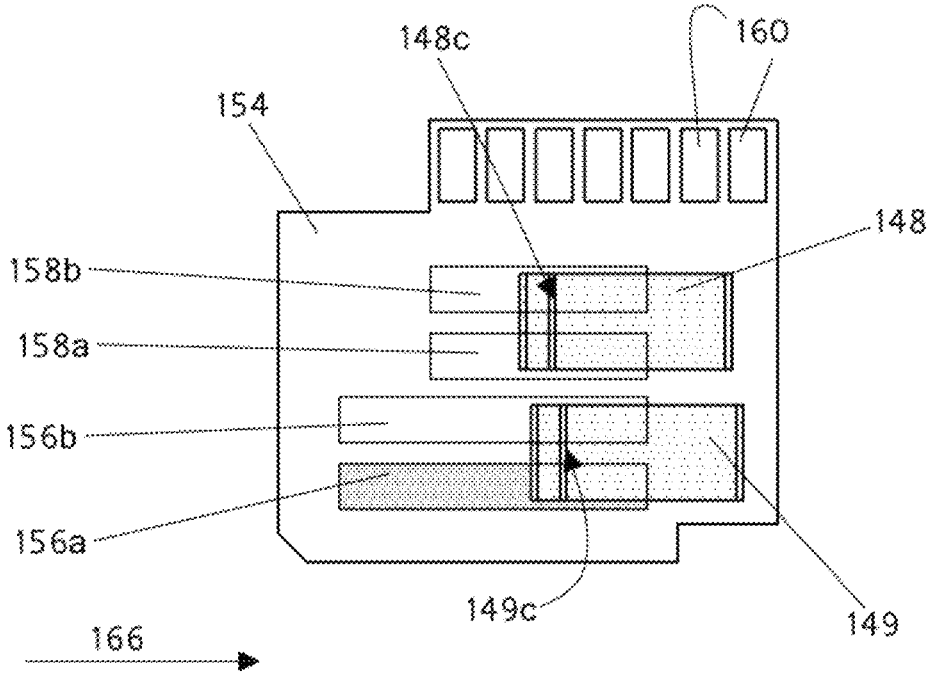

It can be seen that in the two different states shown in FIGS. 5*b* and 5*d* above, the single-pole single-throw switch formed by the metal contact 148 and the two printed metal wires 158*a*, 158*b* is adapted to output one of two discrete signals. These two discrete signals correspond to the closing and opening of the switch. Since the switch itself is not an active device, but requires to be put in the circuit to cut off or turn on the current, the signal referred to here is a passive signal.

Further, starting from the state of FIG. 5*b*, the linear movement of the metal contact 149 in the direction indicated by the arrow 166 in FIG. 5*d* causes the hook portion 149*c* to move relative to the printed metal wire 156*b* and the carbon film 156*a*. Since the distance between either end of the two ends of the carbon film 156*a* and the hook portion 149*c* changes, the resistance of the potentiometer also changes. Specifically, starting from the state shown in FIG. 5*b*, as the metal contact 149 moves in the direction indicated by the arrow 166 in FIG. 5*d*, the resistance of the potentiometer will become larger and larger until the maximum resistance is reached in the position shown in FIG. 5*d*. This causes the metal contacts 148 and 149 connected to the intermediate member 152 to be in the second position shown in FIG. 5*d*, with the intermediate member 152 at the end of the other end of its effective stroke at this time.

In the two different states shown in FIGS. 5*b* and 5*d* above, the difference between the potentiometer formed by the metal contact 149, the printed metal wire 156*b* and the carbon film 156*a* together, and the single-pole single-throw switch formed by the metal contact 148 and the two printed metal wires 158*a*, 158*b*, is that the former continuously produces changes in the resistance of the potentiometer during the pressing of the head 126 and the torque transmitting member 144, while the latter outputs only one of the two discrete signals at most. Therefore, in the case of a potentiometer, it always outputs signals during the pressing and driving of the electric screwdriver. It should be noted that since the potentiometer itself is not an active device, it is required to be put in the circuit to generate impedance and generate a voltage drop, and the signal referred to here is a passive signal.

Figure 6:
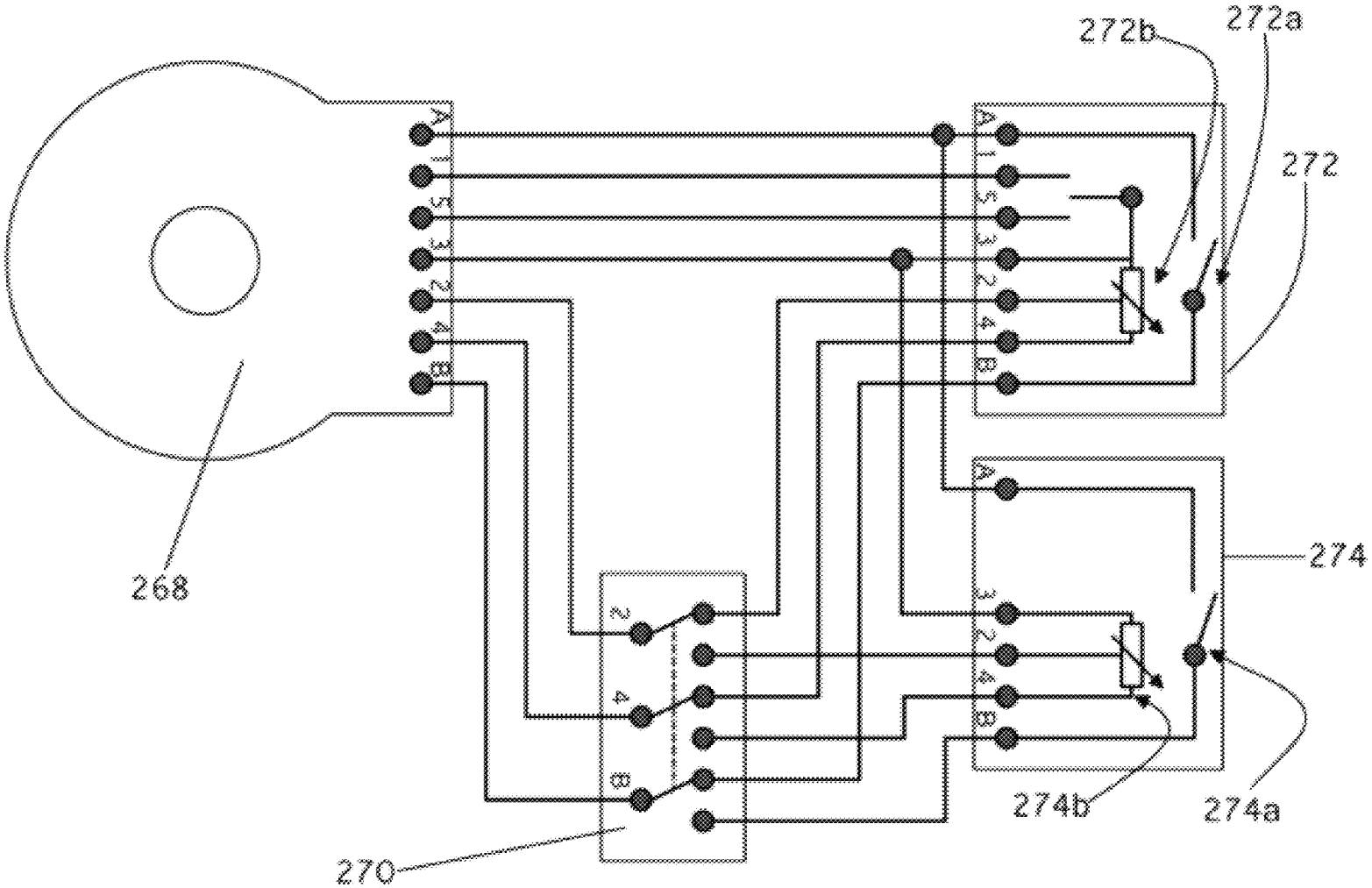
FIG. 6 is a schematic view showing a circuit connection relationship between a main circuit board in the electric screwdriver, the pressing and driving mechanism, and a trigger mechanism according to another embodiment of the invention.

Turning now to FIG. 6, there is shown a schematic view of the wiring of several internal modules of an electric screwdriver according to another embodiment of the invention. The electric screwdriver includes a main PCB board 268, a trigger PCB board 272 and a pressing and driving PCB board 274. Among them, the main PCB board 268 is mainly equipped with a controlling portion of the entire electric screwdriver such as a microprocessor, a motor driving circuit, a motor controlling circuit, etc., as is well known to those skilled in the art. Both the trigger PCB board 272 and the pressing and driving PCB board 274 are connected to the main PCB board 268 by a three-pole double-throw switch board 270. The three-pole double-throw switch board 270 is equipped with a three-pole double-throw switch, such as a switch in the form of a slide, thereby enabling the user to switch the control mode of the motor speed. In particular, the motor speed can be controlled by two different hardware devices. When the three-pole double-throw switch board 270 is in its first switch state (as shown in FIG. 6), the trigger PCB board 272 is connected to the main PCB board 268, and the pressing and driving PCB board 274 is not connected to the main PCB board 268. In this trigger control mode, the user can only control the motor speed by flipping the amount of the trigger by the finger. The trigger and other components to which the trigger PCB board is connected are electrically equivalent to a switch 272*a* and a potentiometer 272*b*, and the function of the potentiometer 272*b* is partially achieved by the trigger. When the three-pole double-throw switch plate 270 is in its second switch state (not shown), the trigger PCB board 272 is not connected to the main PCB board 268, but the pressing and driving PCB board 274 is connected to the main PCB board 268. In this pressing and driving mode, the user can only control the motor speed by pressing an electric screwdriver onto the surface of the workpiece. Specifically, the change in motor speed depends on the amount of displacement of the head of the electric screwdriver and the torque transmitting member, which will affect the potentiometer 274*b* on the pressing and driving PCB board 274 (the potentiometers described with reference to FIGS. 5*a*-5*d*) and the switch 274*a* (the single-pole single-throw switch described with reference to FIGS. 5*a*-5*d*). Whether the electric screwdriver is in the trigger control mode or the pressing and driving mode, the user can apply control to continuously and gradually adjust the motor speed. It should be noted, however, that the running speed of the motor can only be controlled by the switch on the trigger PCB board 272 in this embodiment, and the switch is passed through to the main PCB board 268 without being affected by the three-pole double-throw switch board 270.

Figure 7:
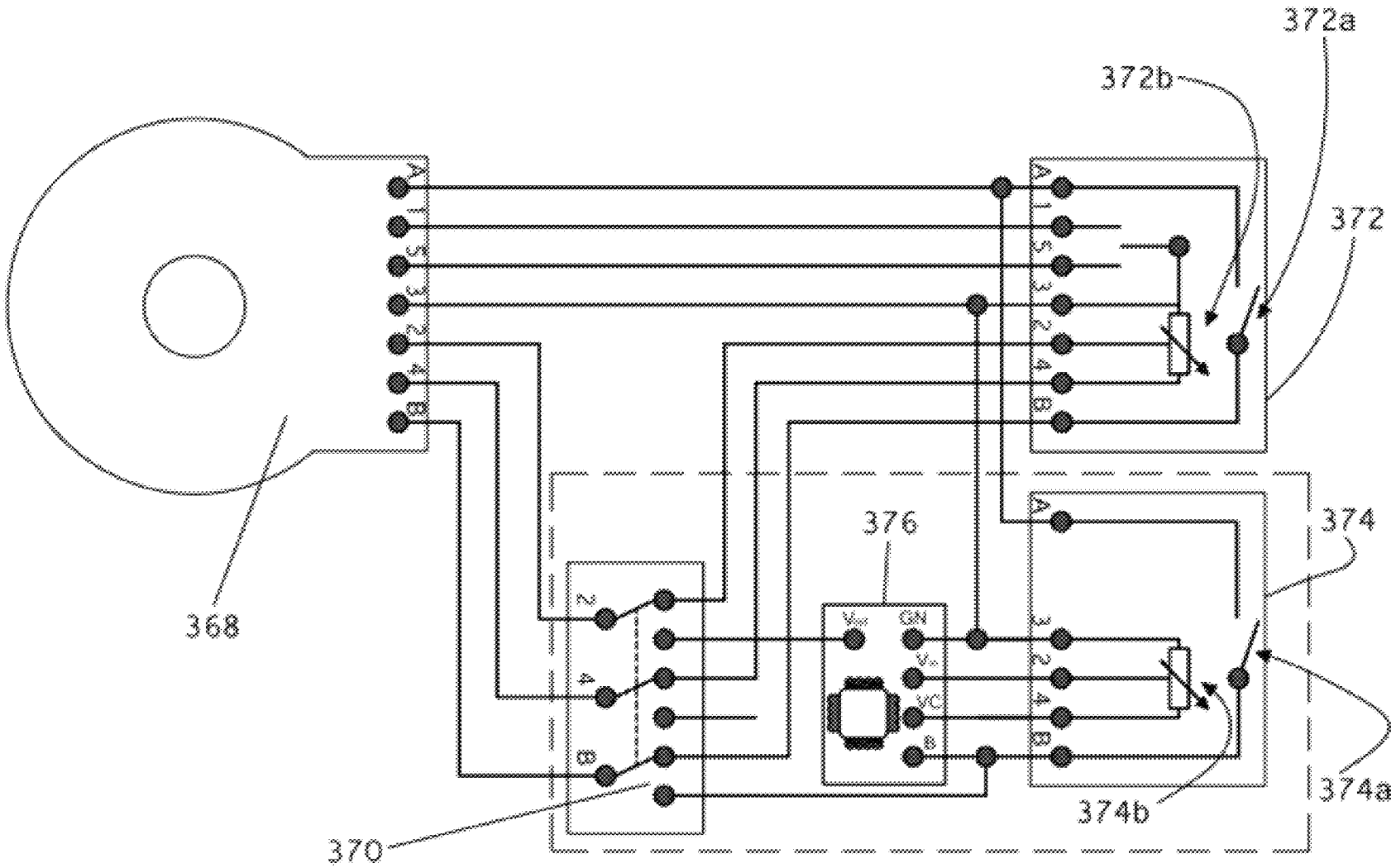
FIG. 7 is a schematic view showing a circuit connection relationship between a main circuit board in the electric screwdriver, the pressing and driving mechanism, and a trigger mechanism according to another embodiment of the invention.

Turning now to FIG. 7, there is shown a schematic view of the wiring of several internal modules of an electric screwdriver according to another embodiment of the invention. The electric screwdriver includes a main PCB board 368, a three-pole double-throw switch board 370, and a trigger PCB board 372 and a the pressing and driving PCB board 374. These components are the same or similar to those in FIG. 6 and will not be described again here. In contrast to FIG. 6, the electric screwdriver of FIG. 7 also includes an expansion PCB board 376. An example of an expansion PCB board 376 is a single board microcontroller and microcontroller package based on the Arduino project. The expansion PCB board 376 is connected to the trigger PCB board 372 and the pressing and driving PCB board 374 before the three-pole double-throw switch board 370. The presence of expansion PCB board 376 allows different settings to be switched by the microprocessor on the expansion PCB board 376 without modifying the main PCB board 368. Such settings are software based such that the control of the trigger PCB board 372 and/or the pressing and driving PCB board 374 causes the mode of motor output speed to change.

Figure 8A:
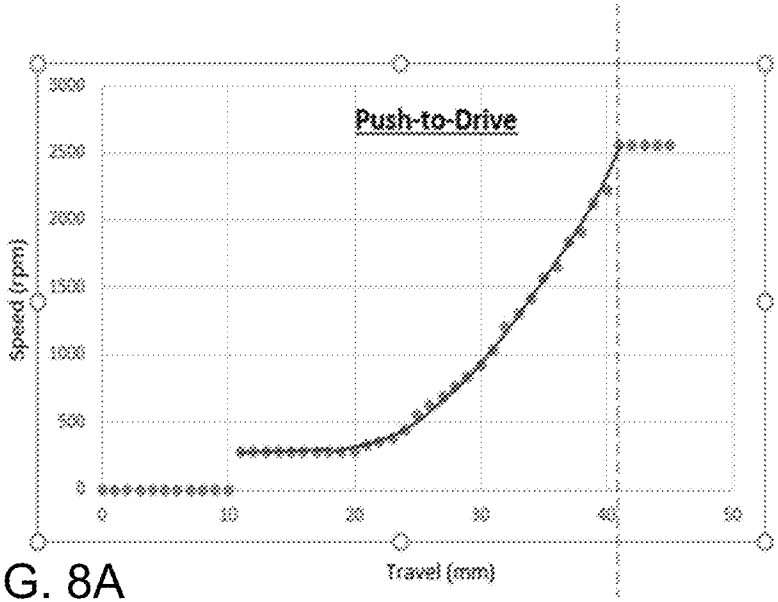
FIGS. 8*a* and 8*b* respectively show a plot diagram of the relationship between a pressing distance and an output speed of a head of the electric screwdriver in two different settings, according to another embodiment of the invention.
Figure 8B:
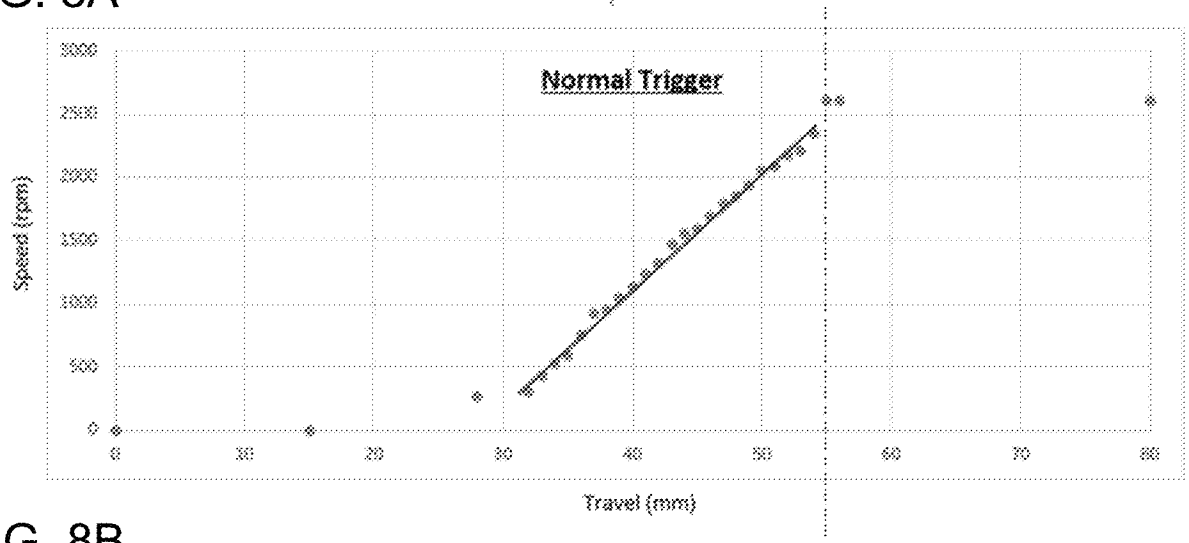

For example, in the embodiments shown in FIGS. 8*a* and 8*b*, two different settings can be set by connecting the expansion PCB board between the main PCB board and the pressing and driving PCB board. In the first setting, as shown in FIG. 8*a*, the relationship between the motor speed and the displacement distance of the pressing and driving mechanism (specifically, the head and the torque transmitting member) is substantially parabolic, and the longer the displacement distance of the pressing and driving mechanism is, the faster the speed changes of the motor (i.e., the acceleration), and vice versa. In the second setting, as shown in FIG. 8*b*, the relationship between the motor speed and the displacement distance of the pressing and driving mechanism is substantially straight, that is, the speed changes (i.e., acceleration) remain the same regardless of whether the displacement distance of the pressing and driving mechanism is large or small.

Figure 9A:
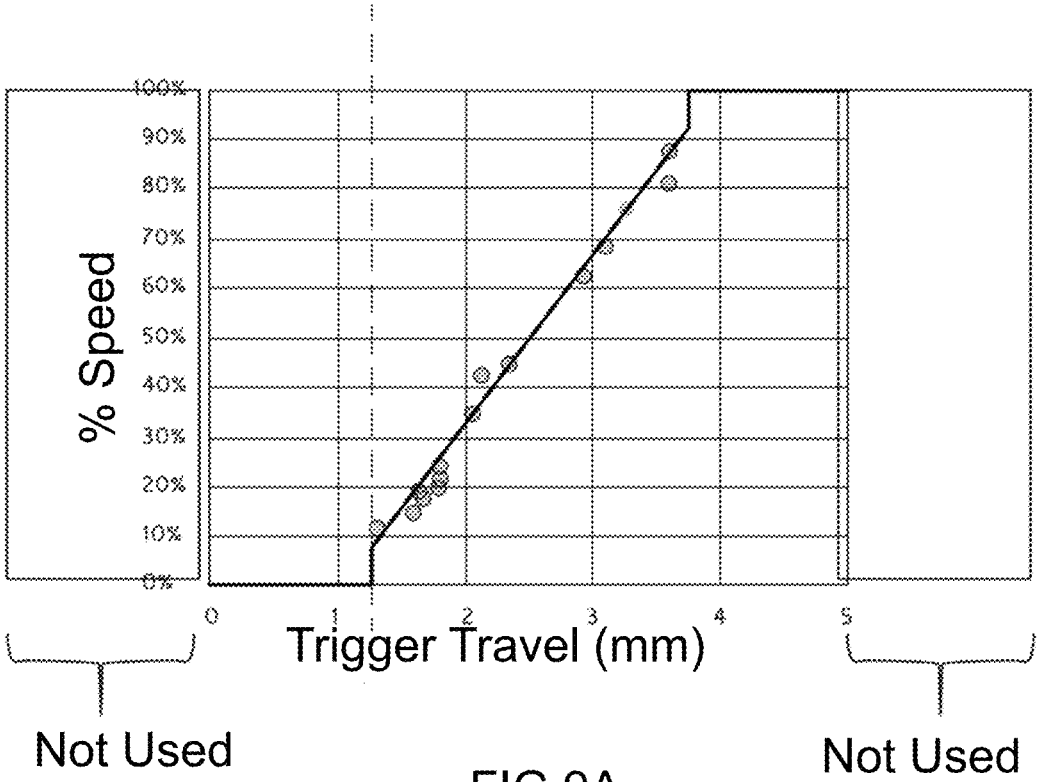
FIGS. 9*a* and 9*b* respectively show a plot diagram of the relationship between a pressing amount of the trigger and the output speed of the electric screwdriver of FIG. 8 in two different settings.
Figure 9B:
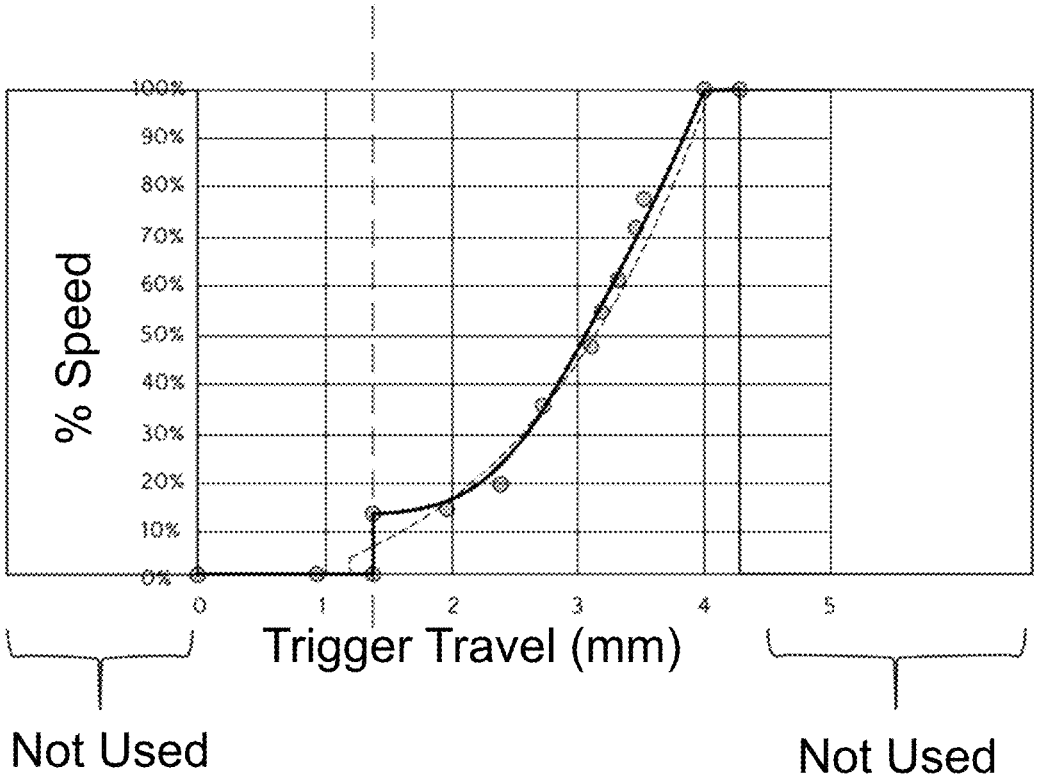

In the embodiment shown in FIGS. 9*a* and 9*b*, two different settings can be set by an expansion PCB board which is connected between the main PCB board and the trigger PCB board. In the first setting, as shown in FIG. 9*b*, the relationship between the motor speed and the amount of pressing of the trigger is generally parabolic, and the greater the amount of pressing of the trigger, the faster the motor speed changes (i.e., acceleration), and vice versa. In the second setting, as shown in FIG. 9*a*, the relationship between the motor speed and the amount of pressing of the trigger is generally straight, that is, the motor speed change (i.e., acceleration) remains constant regardless of whether the amount of pressing of the trigger is large or small.

Figure 10A:
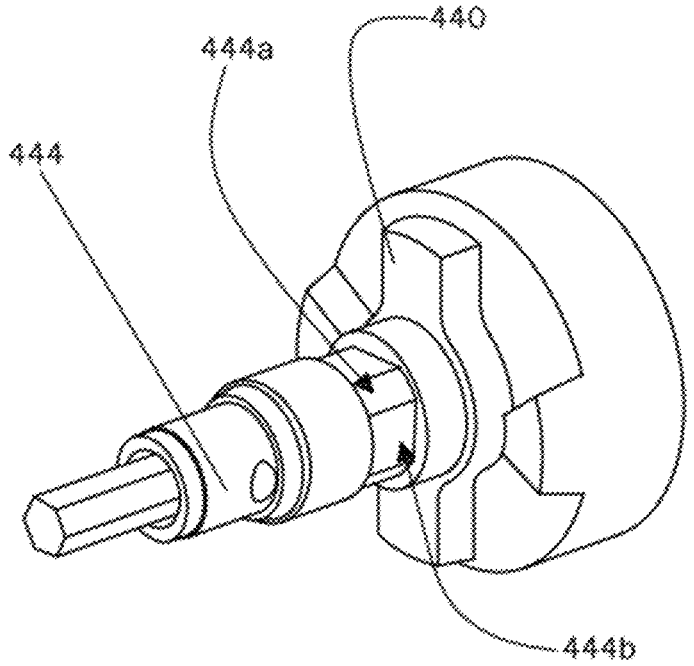
FIG. 10*a* is a schematic connection view of a torque transmitting shaft, an anvil and a hammer inside an electric screwdriver according to another embodiment of the invention.
Figure 10B:
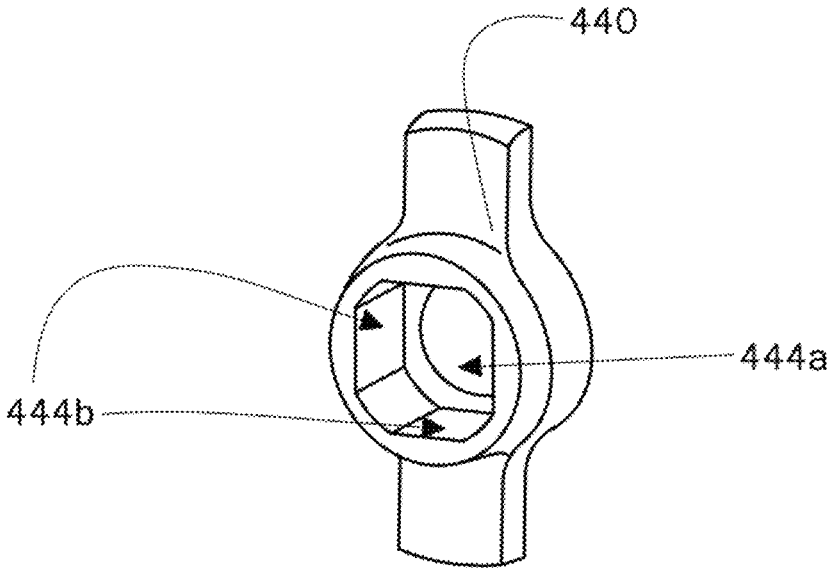
FIG. 10*b* separately shows a perspective view of the anvil of FIG. 10*a*.

Turning now to FIGS. 10*a* and 10*b*, there is shown an electric screwdriver according to one embodiment of the invention has a slightly different pressing and driving mechanism from that of FIGS. 3-4*a*. Specifically, the ring portion 440*a* of the anvil 440 of the pressing and driving mechanism in FIGS. 10*a* and 10*b* has four straight segments 440*b* uniformly distributed in the circumferential direction. Correspondingly, the joint portion 444*a* of the torque transmitting member 444 also has four straight segments 440*b* uniformly distributed in the circumferential direction. In contrast, the joint portion and the joint portion in FIGS. 3-4*a* have only two straight segments.

Having thus described several embodiments, those skilled in the art will recognize that various modifications, other structures, and equivalents can be used without departing from the spirit of the invention. Accordingly, the above description should not be considered as a limitation to the scope of the invention as defined by the following claims.

For example, in the above embodiment, the driving portion to which the pressing and driving mechanism is connected constitutes a potentiometer and a single-pole single-throw switch, and they indirectly output signals as passive elements. However, those skilled in the art will recognize that in other variations of the invention, active components may also be provided in the driving portion to output an active (initiative) signal directly and indirectly depending on the operational state of the pressing and driving mechanism.

Further, in the above embodiment, the shape of the joint portion between the torque transmitting portion and the anvil in the pressing and driving mechanism has two or four straight segments in the circumferential direction. However, in other variations, there may be other numbers of straight segments, which may be more or less.

What is claimed is:

1. A pressing and driving mechanism adapted for use with an electric screwdriver, the pressing and driving mechanism comprising:

a housing;

a torque transmitting shaft connected to the housing for sliding movement relative to the housing in an axial direction;

an anvil configured to receive rotational impacts and coupled to the torque transmitting shaft for transmitting the rotational impacts thereto;

a shuttle coupled to the torque transmitting shaft for movement therewith relative to the housing in the axial direction;

a terminal assembly connected to the shuttle and movable with the same; and a printed circuit board fixed relative to the housing and adapted to be in mechanical contact with the terminal assembly, wherein the terminal assembly and the printed circuit board form a potentiometer with a resistance value that is variable in dependence upon a position of the terminal assembly relative to the printed circuit board.

2. The pressing and driving mechanism of claim 1, wherein the torque transmitting shaft is axially movable relative to the anvil in response to user intervention.

3. The pressing and driving mechanism of claim 1, wherein the torque transmitting shaft is movable from a first position to a second position in response to user intervention, and wherein the pressing and driving mechanism further comprises a spring configured to bias the torque transmitting shaft toward the first position.

4. The pressing and driving mechanism of claim 3, wherein the electric screwdriver includes a motor, wherein the potentiometer is configured to prevent the motor from operating when the torque transmitting shaft is in the first position, and wherein the potentiometer is configured to permit the motor to operate when the torque transmitting shaft is in the second position.

5. The pressing and driving mechanism of claim 3, wherein the torque transmitting shaft is at a forwardmost position relative to the housing in the first position and a rearmost position relative to the housing in the second position.

6. The pressing and driving mechanism of claim 1, wherein the terminal assembly is configured as a first metal contact and a second metal contact received by the shuttle.

7. The pressing and driving mechanism of claim 6, wherein the first metal contact is movable along two parallel strips, and the second metal contact is movable along two parallel printed metal wires, and wherein the two parallel strips and the two parallel printed metal wires are defined on the printed circuit board.

8. The pressing and driving mechanism of claim 7, wherein the two parallel strips are a carbon film and a printed metal wire, respectively.

9. An electric screwdriver comprising:

a housing;

a torque transmitting shaft connected to the housing for sliding movement relative to the housing in an axial direction in response to user intervention from a first position to a second position;

an impact mechanism including an anvil configured to receive rotational impact and coupled to the torque transmitting shaft for transmitting the rotational impacts thereto, a camshaft configured to be driven by the motor to rotate, and a hammer coupled to and driven by the camshaft to impart rotational impacts to the anvil;

a shuttle operatively coupled to the torque transmitting shaft for movement therewith relative to the housing in the axial direction; and a first metal contact configured to be received by the shuttle, wherein the first metal contact is movable with the torque transmitting shaft between the first position and the second position.

10. The electric screwdriver of claim 9, wherein the torque transmitting shaft is axially movable relative to the anvil in response to the user intervention.

11. The electric screwdriver of claim 9, further comprising a second metal contact configured to be received by the shuttle.

12. The electric screwdriver of claim 11, wherein the first metal contact is operable to move along two parallel strips affixed to the housing and the second metal contact is operable to move along two parallel printed metal wires affixed to the housing, and wherein the first metal contact and the two parallel strips define a potentiometer with a resistance value that is variable in dependence upon a position of the first metal contact relative to the printed metal wire and the carbon film.

13. The electric screwdriver of claim 12, wherein the two parallel strips are a carbon film and a printed metal wire, respectively.

14. An electric screwdriver comprising:

a housing;

a motor supported by the housing;

a torque transmitting shaft connected to the housing for sliding movement relative to the housing in an axial direction between a forwardmost position and a rearmost position;

an anvil configured to receive rotational impacts and coupled to the torque transmitting shaft for transmitting the rotational impacts thereto;

a shuttle coupled to the torque transmitting shaft for movement therewith relative to the housing in the axial direction;

a terminal assembly connected to the shuttle and movable with the same; and a printed circuit board fixed relative to the housing and adapted to be in mechanical contact with the terminal assembly, wherein the terminal assembly and the printed circuit board form a potentiometer configured to prevent the motor from operating when the torque transmitting shaft is in the forwardmost position, and wherein the potentiometer is configured to permit the motor to operate when the torque transmitting shaft is in the rearmost position.

15. The electric screwdriver of claim 14, wherein the torque transmitting shaft is axially movable relative to the anvil in response to user intervention.

16. The electric screwdriver of claim 14, wherein the torque transmitting shaft is movable from the rearmost position to the forwardmost position in response to user intervention, and wherein the screwdriver further comprises a spring configured to bias the torque transmitting shaft toward the forwardmost position.

17. The electric screwdriver of claim 16, wherein the motor is operated at a first speed in response to a first user input that linearly displaces the torque transmitting shaft to a first position between the forwardmost and rearmost positions, and wherein the motor is operated at a second speed in response to a second user input that linearly displaces the torque transmitting shaft to a second position between the forwardmost and rearmost positions.

18. The electric screwdriver of claim 14, wherein the terminal assembly is configured as a first metal contact and a second metal contact received by the shuttle.

19. The electric screwdriver of claim 18, wherein the first metal contact is movable along two parallel strips, and the second metal contact is movable along two parallel printed metal wires, and wherein the two parallel strips and the two parallel printed metal wires are defined on the printed circuit board.

20. The electric screwdriver of claim 19, wherein the two parallel strips are a carbon film and a printed metal wire, respectively.

* * * * *